US006203595B1

(12) United States Patent
Edlinger

(10) Patent No.: US 6,203,595 B1
(45) Date of Patent: Mar. 20, 2001

(54) PROCESS FOR WORKING UP RESH OR SHREDDER LIGHT FRACTIONS, WITH $CACO_3$

(75) Inventor: Alfred Edlinger, Baden (CH)

(73) Assignee: "Holderbank" Financiere Glarus AG, Baden (CH)

( * ) Notice: Subject to any disclaimer, the term of this patent is extended or adjusted under 35 U.S.C. 154(b) by 0 days.

(21) Appl. No.: 09/209,000

(22) Filed: Dec. 11, 1998

(30) Foreign Application Priority Data

Dec. 11, 1997 (AT) ..... 2093/97

(51) Int. Cl.[7] ..... C21B 11/00; C22B 15/00; C01F 11/18

(52) U.S. Cl. ..... 75/639; 75/500; 423/430

(58) Field of Search ..... 75/639, 500; 423/430

(56) References Cited

U.S. PATENT DOCUMENTS 3,897,739 8/1975 Goldbach .
5,060,584 10/1991 Sowards et al. .
5,364,443 * 11/1994 Tremblay et al. ..... 75/403
5,776,226 * 7/1998 Edlinger ..... 75/500

FOREIGN PATENT DOCUMENTS 32 24 328 A1 7/1983 (DE) .
607 659 A1 7/1994 (EP) .

* cited by examiner

*Primary Examiner*—Melvyn Andrews
(74) *Attorney, Agent, or Firm*—Pillsbury Madison & Sutro LLP

(57) ABSTRACT

In this process for working up RESH or shredder light fractions, the RESH or shredder light fractions are charged into a fluidized bed gasifier. Hot wind or combustion off-gases having a temperature above 450° C. are blown into the fluidized bed through nozzles while forming a counterflow grinding space. $CaCO_3$ is introduced into the fluidized bed and calcined in the grinding space to effect disintegration.

22 Claims, 2 Drawing Sheets

PROCESS FOR WORKING UP RESH OR SHREDDER LIGHT FRACTIONS, WITH $CACO_3$

BACKGROUND OF THE INVENTION

1. Field of the Invention

The invention relates to a process for working up RESH or shredder light fractions, in which the RESH or the shredder light fractions are charged into a fluidized bed gasifier.

2. Description of the Related Art

As referred to herein RESH or shredder light fraction encompasses recycling products, and in particular, those occurring in the working up of motor vehicles. Such recycling products contain high amounts of organic substances, such as, rubber-like products as well as fabric fibers incapable of being readily disintegrated in conventional mills. Consequently, the usual working up of such recycling products having high portions of organic components generally comprises combustion or pyrolysis followed by mechanical further processing.

Jet mills, in particular, have been proposed for mechanically disintegrating mineralic starting products. Jet mills usually are operated by compressed air with the material ground in such jet mills being dischargeable via a screening device. Depending on the grinding stock and the grinding time, material of variable fineness may be produced. Like any other mills, however, jet mills are not suitable for sufficiently disintegrating waste substances having high organic portions such as, e.g., RESH.

SUMMARY OF THE INVENTION

The invention aims at providing a simple process of the initially defined kind, by which it is feasible to utilize the energetic content of RESH or shredder light fractions while, at the same time, ensuring a high degree of disintegration and comminution. Moreover, the process according to the invention is aimed at directly providing comminuted materials capable of being converted in a simple manner into end products that are practically usable from an economic point of view. To solve these objects, the process according to the invention essentially resides in that hot air or combustion offgases having temperatures of above 450° C. are blown into the fluidized bed through nozzles thereby forming a counterflow grinding space and that $CaCO_3$ is introduced into the fluidized bed and calcined in the grinding space achieve disintegration. By charging starting materials comprising RESH or shredder light fractions into a fluidized bed gasifier, it is feasible to gasify the portion of organic substances and, in particular, elastic rubber-like materials contained in the starting materials to a synthesis gas essentially consisting of carbon monoxide and hydrogen. Such a fluidized bed gasification calls for temperatures of more than 450° C., wherein the process is controlled in a manner so as to achieve gasification but no quantitative combustion such that the synthesis gas forming still has a high calorific value. The reaction, thus, has to be conducted in a substoichiometric manner in order to keep the $CO_2$ content in the fluidized bed atmosphere accordingly low. By carrying out gasification at temperatures of above 450° C., it is feasible at a sufficiently high temperature and by the simultaneous introduction of calcium carbonate ($CaCO_3$), in particular in the form of limestone or lime marl, into the fluidized bed to calcine such calcium carbonate while such calcium carbonate or burnt lime may be accordingly disintegrated in the fluidized bed at the same time, if a counterflow grinding space is formed in the fluidized bed. Such a disintegrated calcined material acts as an effective disintegration aid, enabling fine grinding in the counterflow grinding space. Even starting materials that are difficult to disintegrate can be finely ground. Generally, the addition of calcium carbonate into the fluidized bed under suitable conditions, ensures the immediate formation of a disintegrated solid material capable of being discharged from the counterflow grinding space or fluidized bed and subsequently melted and thermally processed further with the formed burnt line. Thus, process control following disintegration is enhanced.

Advantageously, the process according to the invention is conducted in a manner that the starting products (also referred to herein as starting materials) are charged at a maximum particle size of 25 mm and, preferably, 20 mm. In order to enhance process control and with a view to the direct production of economically usable slags and, in particular, hydraulically active slags, the process according to the invention advantageously is realized such that aluminate carriers are introduced into the fluidized bed in an amount yielding an $Al_2O_3$ content of between 12 and 25% by weight and, preferably, about 15% by weight after melt reduction of the disintegrated particles. By appropriately adjusting the CaO and $Al_2O_3$ contents, cement-like products may be immediately produced, which may at least be employed as cement grinding additives. To this end, the process according to the invention advantageously is carried out in that $CaCO_3$ is introduced in an amount which, after a melt reduction of the disintegrated particles, yields a basicity $CaO/SiO_2$ of between 1.3 and 1.9 and, preferably, 1.5.

Within the scope of the process according to the invention, thermokinetic disintegration takes place in the fluidized bed with elastic materials being gasified and inorganic particles such as glass and metals being mechanically crushed. At the same time, the limestone or lime marl added is comminuted and calcined. In order to ensure an appropriate comminution effect, it however, care must be taken to ensure that the portion of ductile material in the fluidized bed does not become too high. In particular, it is advantageous to accordingly limit the total iron content, wherein the process according to the invention advantageously is carried out such that RESH or the shredder light fraction is subjected to magnetic separation, optionally upon coarse crushing, and charged at a total iron content of less than 6% by weight.

The total copper content advantageously may be kept higher than 0.5% by weight in view of the subsequent recovery of heavy metals or nonferrous heavy metals. Simple magnetic separation offers essential advantages in this case.

In a particularly advantageous manner, the disintegrated particles are drawn off from the fluidized bed gasifier, or the grinding space, via a screening means and supplied to a melting aggregate, particularly a melting cyclone, whereupon the melt obtained is reduced above a metal bath and, in particular, an iron bath. Generally, the material thermokinetically disintegrated in the fluidized bed, leaves the fluidized bed at grain sizes of 2 mm at most. In a particularly advantageous manner, the disintegrated material may be melted in a melting cyclone and subjected to appropriate melt reduction, to which end a metal bath and, in particular, an iron bath is particularly preferred. In such a melt reduction above an iron bath, different phases may be drawn off with a two-phase metal regulus being present. A heavy phase primarily contains copper up to 80% by weight as well as iron, tin, nickel and chromium. A second, lighter phase comprises iron up to 90% by weight as well as copper, nickel, chromium and about 4% by weight carbon. Such phases subsequently may be separated in a simple manner. The process according to the invention advantageously is carried out such that a heavier Cu-containing phase is drawn off the metal bath reactor upon segregation by liquation and such that the remaining, iron-containing phase at least partially is left in the metal bath reactor as a metal bath.

Yet another option of enriching metallic components according to a preferred mode of operation may be provided in that the disintegrated particles are sucked off via a hot cyclone, the coarse stock occurring in the hot cyclone at least partially is returned to the fluidized bed, and the fine stock leaving the hot cyclone is fed to a melting aggregate, in particular a melting cyclone, whereupon the molten slag is reduced above a metal bath. By arranging a melting cyclone not immediately after the grinding space or fluidized bed gasifier, but interposing the hot cyclone between the fluidized bed and the melting cyclone, it is feasible to separate coarse stock, which primarily is comprised of ductile materials difficult to disintegrate, and hence of metallic phases. By at least partially returning the coarse stock into the fluidized bed, the metallic components may be enriched in circulation and worked up separately. In this case, only the fine stock containing mineral portions emerges from the hot cyclone and is fed to a melting unit, in particular a melting cyclone, and subsequently treated preferably in a metal bath reactor.

Advantageously, the process according to the invention is carried out such that the temperature in the fluidized bed or in the grinding space is adjusted to between 450° C. and 700° C. and the $CO_2$ content of the fluidized bed atmosphere is kept at below 30% by volume, preferably below 15% by volume, appropriate calcining being observable already at temperatures of about 700° C. The energetic yield may be enhanced in that the combustion offgases for operating the fluidized bed mill at least partially are produced by burning the offgases of the gasification reaction in the fluidized bed, this preferably being effected in a substoichiometric manner.

In order to directly produce cement-like end products, the process advantageously is realized in a manner that RESH and limestone are used at a weight ratio of 1.5:1 to 3:1.

On the whole, the process according to the invention ensures particularly good disintegration and suitable process control, thereby enabling metallic phases to be recovered at high contribution margins, wherein the propulsion jet for the fluidized bed mill may be generated by burning synthesis gases at least partially obtained in the process. Substoichiometric combustion in the fluidized bed produces a synthesis gas exhibiting a sufficient combustion heat, wherein converter offgases from the metal bath reactor, which likewise contain high portions of hydrogen and about 20% by weight of carbon monoxide, may be used for the production of the hot gases for the propulsion jet. In addition, waste fuel may be introduced directly into the fluidized bed or into preceding combustion chambers.

In the metal bath reactor, a phase rich in iron is provided as a particularly effective reaction medium on account of the usually high carbon portion. The copper-rich phase, as a rule, has an extremely low solvent power for carbon, thus acting in an almost inert manner in the melt reduction. The atmophile heavy metals such as zinc and lead occur concentrated during the first minutes of the melt reduction and may be recovered from the converter offgases in concentrated form.

The sulfur contained in the starting materials practically quantitatively is to be refound in the reduced slag, such a sulfur content definitely exhibiting positive properties in regard to the subsequent use as a cement grinding admixture. The chlorine content of the starting product RESH binds practically quantitatively with the alkalis dragged in as well as, at least partially, with the heavy metals present (Cu, Zn, Pb), quantitatively evaporating already in the fluidized bed as well as in the melting cyclone.

BRIEF DESCRIPTION OF THE DRAWINGS

The invention will now be explained in more detail by way of arrangements suitable for carrying out the process according to the invention. These arrangements are schematically illustrated in the drawings, wherein.

DETAILED DESCRIPTION OF PREFERRED EMBODIMENTS OF THE INVENTION

Figure 1:
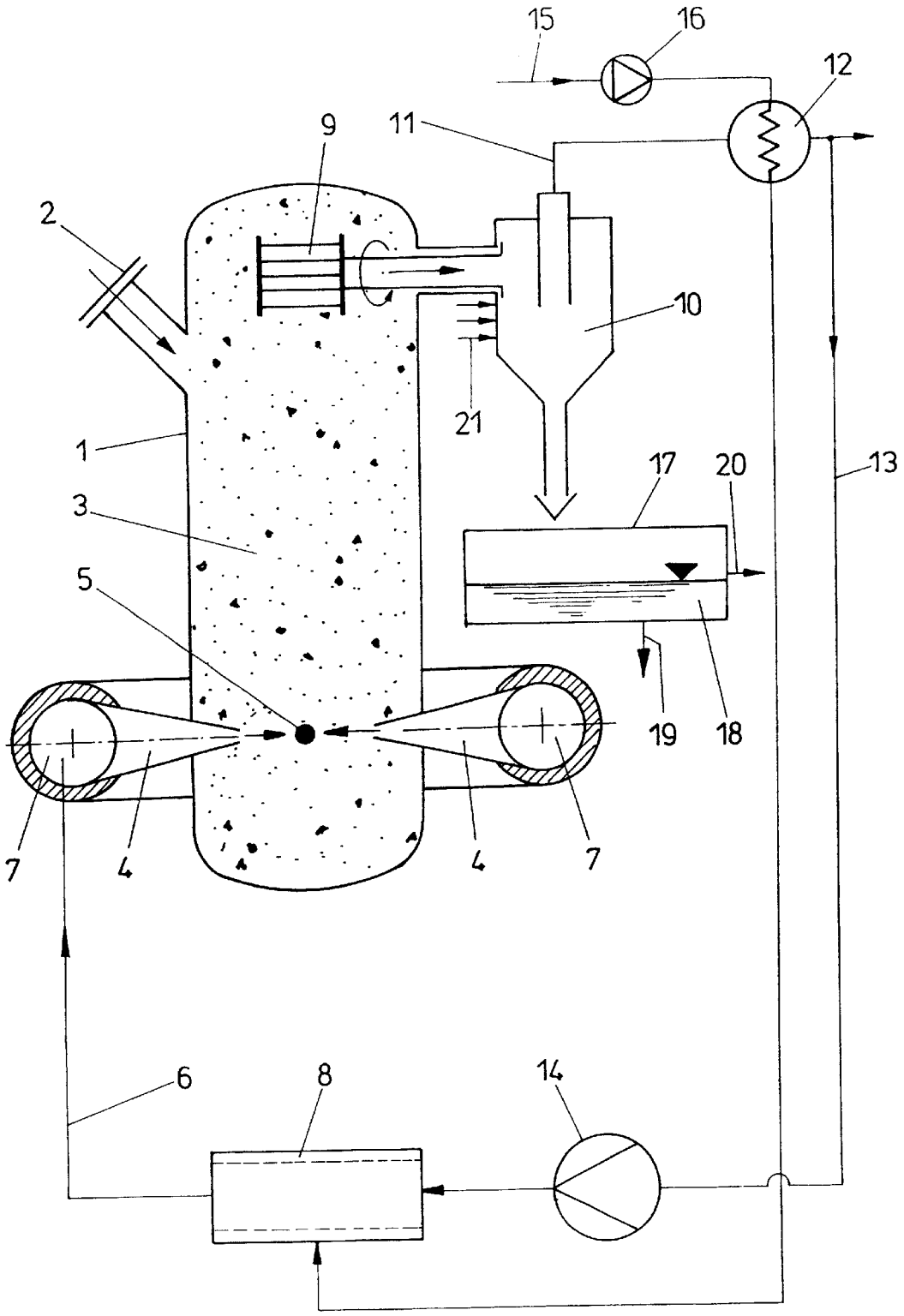
FIG. 1 is a partially sectioned schematic illustration of a first embodiment of an arrangement for working up RESH or motor vehicle shredder light fractions.

In FIG. 1 a fluidized bed gasifier (also referred to herein as a fluidized bed reactor) 1 is illustrated, through whose charging socket 2 RESH is charged along with limestone and optionally bauxite or grinding dusts as aluminate carriers. A fluidized bed 3 is formed in the interior of the fluidized bed reactor with a suitable propellant being blown into the reactor 1 through jet tubes 4. The jet tubes 4 have respective axes oriented such that the jet direction aims at a common grinding point 5. The propellant gas is passed through a duct 6 and fed to annular duct 7 to which the jet tubes 4 are connected.

In the instant case, combustion offgases are used as propellant gases in order to ensure a temperature of above 450° C. in the interior of the fluidized bed reactor 1. The combustion chamber for producing the combustion offgases is denoted by 8.

The product gasified in the interior of the fluidized bed reactor 1 is appropriately disintegrated in the grinding space and, in particular, at the grinding point 5. Fine stock is discharged into a melting cyclone 10 through a screening means 9. The synthesis gas formed, which occurs as a gasificiation product of the fluidized bed gasifier, is drawn off via a duct 11 and conducted through a heat exchanger 12, whereupon this synthesis gas at least partially is fed to the combustion chamber 8 as a burning gas via a duct 13 and a compressor 14. Cold air for the combustion in the combustion chamber 8 is sucked in via a duct 15, the respective aspiration means being denoted by 16. The cold air is heated in the heat exchanger 12 and fed to the combustion chamber 8 as hot air, optionally along with oxygen.

The melting product of the melting cyclone is discharged into an iron bath reactor 17, in which a liquid slag floats on an iron bath 18. During the reduction of the liquid slag, the iron bath 18 takes up further metallic portions, wherein, in particular, a heavier phase containing a high amount of copper may be drawn off through a duct 19 after liquation. The iron bath remains in the iron bath reactor 17. The slag may be tapped via a duct 20. By suitable adjustment of the lime batch or portion of aluminate carriers in the fluidized bed 3 it is feasible to directly draw off, through tap 20, a product whose composition corresponds to a synthetic cement or a suitable cement aggregate.

Additional combustion air or oxygen is introduced into the melting cyclone via ducts 21.

Figure 2:
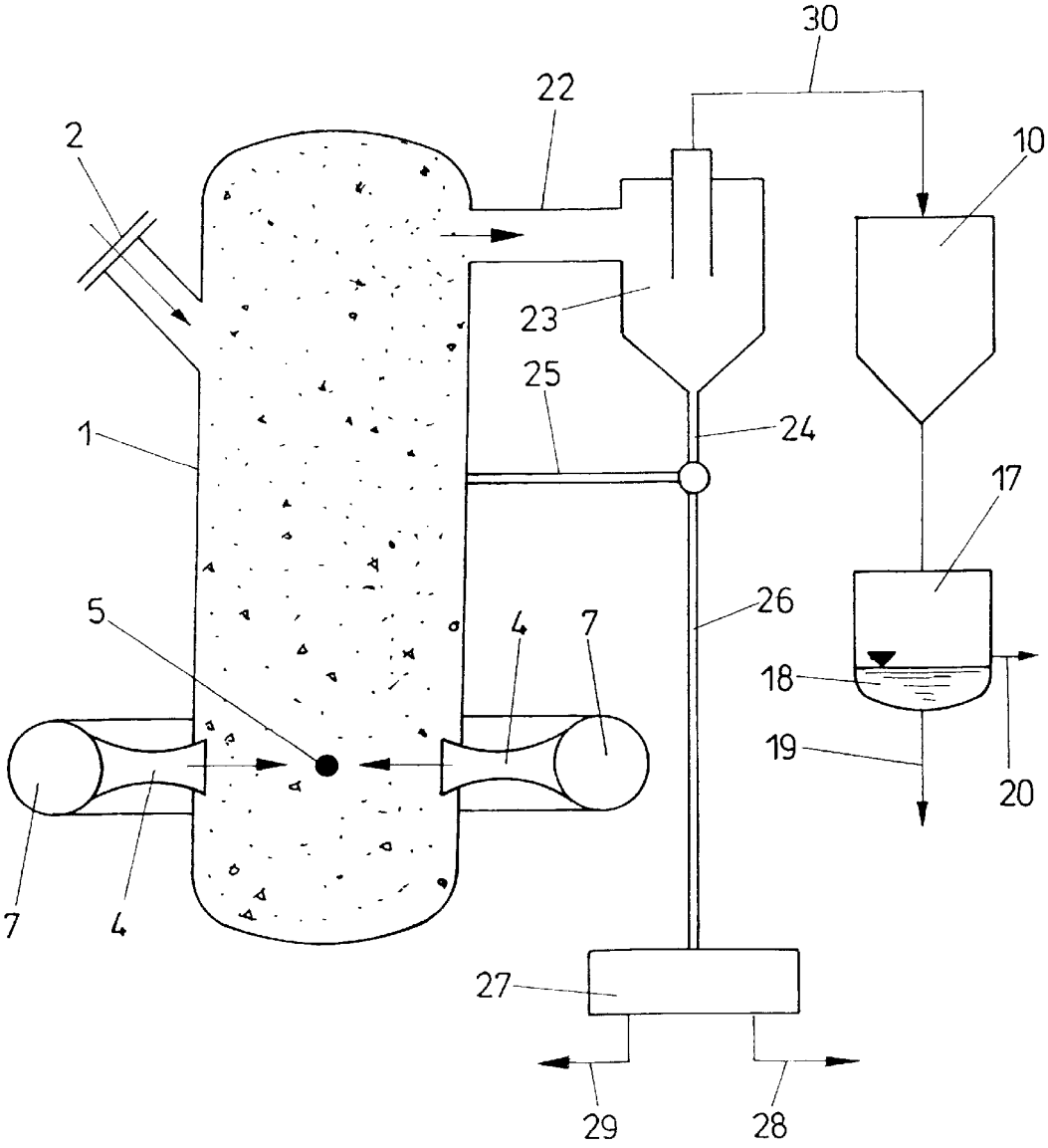
FIG. 2 is a modified embodiment of the arrangement according to FIG. 1.

In the configuration according to FIG. 2 the screening means has been omitted. In this embodiment, Laval nozzles are used as jet tubes 4 with a grinding point 5 and the pertinent grinding space being again formed in the gasification reactor 1. For the sake of clarity, the elements of the propellant gas production for the nozzles to the grinding space are not illustrated in FIG. 2.

The at least partially calcined and accordingly disintegrated product is supplied to a hot cyclone 23 through a duct 22. From the hot cyclone 23 coarse portions are discharged as coarse stock through a duct 24. The coarse stock is at least partially recyclable into the fluidized bed gasifier 1 via a duct 25. In the instant case, the coarse stock primarily contains ductile components difficult to disintegrate, thus essentially consisting of metal parts. After appropriate enrichment of the metal parts, the latter via a duct 26 may be supplied to mechanical processing 27 where iron may be separated from nonferrous metals, for instance, by magnetic separation and discharged via separate discharge ducts 28 and 29.

The fine stock separated in the hot cyclone 23, together with the synthesis gas, or product gas from the fluidized bed reactor 1, is supplied via a duct 30 to a melting cyclone 10, from which the melt passes into an iron bath reactor 17 and is reduced in a manner analogous to the configuration according to FIG. 1 while separating a copper phase through duct 19. The reduced slag is discharged through duct 20 and may be further processed accordingly.

On the whole, reactive grinding, occurs in the fluidized bed reactor 1 while utilizing the high calorific value of a motor vehicle shredder light fraction or RESH as well as the respective calorific value of coarse-crushed household refuse.

Grinding dusts may be directly used as aluminate carriers. The grinding dusts may be used in the moist state, since the grinding dusts are subjected to drying in the hot fluidized bed. The disintegration of the refuse containing high organic portions, or motor vehicle shredder light fraction, is substantially enhanced by the addition of limestone and bauxite. The use of limestone offers the additional advantage that practically the total amount of sulfur contained in the charging substances and, above all, the amount of sulfur contained in RESH is bonded in the lime within the fluidized bed. Expenditures involved in subsequent offgas treatment are, thus, considerably reduced.

Optionally, an offgas from the iron bath reactor 17, which offgas in any event likewise comprises approximately 20% by weight carbon monoxide and hydrogen, may be fed to the combustion chamber, this being not illustrated in the drawing. The mode of procedure in the melt reduction process naturally requires the maintenance of a suitable temperature. Heating is feasible in any desired economically efficient manner. As the residual carbon content of the iron bath is partially burnt, the respective melting heat and the respective converter offgas having a high calorific value can be immediately formed. To this end, oxygen or air is blown through the iron bath. Alternately, the melt bath may be top-blown by lances. Finally, it is possible to use burners, wherein the necessary heat also may be introduced electrically.

Typically, roughly descrapped RESH contains 44% inorganic portions and 56% combustible portions as well as water. In a typical manner, 65% by weight of roughly descrapped RESH along with 30% by weight of limestone and 5% by weight of dry lumpy bauxite may be introduced into the fluidized bed mill or fluidized bed reactor.

A typical analysis of the inorganic portions of RESH is indicated as follows:

RESH Analysis (inorganic matter)

| Component | Portion (%) |
|---|---|
| $SiO_2$ | 55 |
| CaO | 15 |
| $Al_2O_3$ | 13 |
| $Fe_2O_3$ | 5 |
| $Na_2O$ | 3.5 |
| $K_2O$ | 2.3 |
| MgO | 2 |
| Pb | 0.1 |
| $TiO_2$ | 1 |
| MnO | 0.2 |
| Zn | 0.5 |
| $SO_3$ | 0.1 |
| P | 0.7 |
| Cr | 2.5 |
| Cu | 2.1 |
| Ni | 0.1 |
| Cl | 2 |

The sulfur is quantitatively bound to the calcium introduced. Chloride evaporates with the alkalis and, partially, with the heavy metals (Cu, Zn, Pb) in the fluidized bed as well as in the melting cyclone. The sulfur charged is quantitatively contained in the slag drawn off the iron bath reactor.

When using grinding dusts as aluminate carriers, a considerable contribution margin may be expected, since such grinding dusts usually are only difficult to dispose of.

From one ton of RESH approximately half a ton of slag appropriately purified from metals and heavy metals is formed, which can be used further immediately.

What I claim is:

1. A process for working up starting materials comprising a member selected from the group consisting of RESH and shredder light fractions, said process comprising:

charging the starting materials into a fluidized bed gasifier having a fluidized bed;

blowing at least one gas selected from the group consisting of hot air and combustion offgases having a temperature of above 450° C. through nozzles into the fluidized bed gasifier and thereby forming a counterflow grinding space;

introducing $CaCO_3$ into the fluidized bed gasifier; and calcining the $CaCO_3$ in the counterflow grinding space to disintegrate the $CaCO_3$ into disintegrated particles.

2. The process of claim 1, wherein the starting materials are charged at a maximum particle size of 25 mm.

3. The process of claim 1, wherein the starting materials are charged at a maximum particle size of 20 mm.

4. The process of claim 1, wherein further comprising melt reducing the disintegrated particles.

5. The process of claim 4, further comprising introducing aluminate carriers into the fluidized bed gasifier in an amount yielding an $Al_2O_3$ content of between 12% by weight and 25% by weight after said melt reducing of the disintegrated particles.

6. The process of claim 4, further comprising introducing aluminate carriers into the fluidized bed gasifier in an amount yielding an $Al_2O_3$ content of 15% by weight after said melt reducing of the disintegrated particles.

7. The process of claim 4, wherein the $CaCO_3$ is introduced in an amount so as to yield a basicity of $CaO/SiO_2$ of between 1.3 and 1.9 after said melt reducing of the disintegrated particles.

8. The process of claim 4, wherein the $CaCO_3$ is introduced in an amount so as to yield a basicity of $CaO/SiO_2$ of 1.5 after said melt reducing of the disintegrated particles.

9. The process of claim 1, wherein the RESH and shredder light fractions contain iron, and wherein said process further comprises:

drawing the disintegrated particles off from the counterflow grinding space of the fluidized bed gasifier and screening the disintegrated particles;

melting the disintegrated particles to form a melt; and providing a metal bath reactor containing a metal bath and reducing the melt above the metal bath.

10. The process of claim 9, wherein said melting of the disintegrated particles is performed in a melting cyclone.

11. The process of claim 9, wherein the metal bath is an iron bath.

12. The process of claim 1, wherein the RESH and shredder light fractions contain iron, and wherein said process further comprises:

providing a hot cyclone and drawing off the disintegrated particles from the fluidized bed gasifier, the disintegrated particles comprising coarse stock and fine stock;

returning at least a portion of the coarse stock from the hot cycle to the fluidized bed gasifier;

discharging the fine stock from the hot cyclone and melting the discharged fine stock to produce a molten slag; and providing a metal bath reactor containing a metal bath and reducing the molten slag above the metal bath.

13. The process of claim 12, wherein said melting of the discharged fine stock is performed in a melting cyclone.

14. The process of claim 1, wherein the fluidized bed and the counterflow grinding space are between 450° C. and 700° C. in temperature, and wherein the fluidized bed has a $CO_2$ content of less than 30% by volume.

15. The process of claim 14, wherein the $CO_2$ content of the fluidized bed is below 15% by volume.

16. The process of claim 1, further comprising burning gasification reaction offgases in the fluidized bed gasifier, and returning the gasification reaction offgases to the fluidized bed as the combustion offgases.

17. The process of claim 16, wherein said burning of the gasification reaction offgases is conducted in a substoichiometric amount.

18. The process of claim 1, wherein the RESH and $CaCO_3$ are introduced into the fluidized bed gasifier at a weight ratio between 1.5:1 and 3:1.

19. A process for working up starting materials comprising a member selected from the group consisting of RESH and shredder light fractions, the RESH and shredder light fractions containing iron, said process comprising:

subjecting the starting materials to magnetic separation to provide the starting materials with a total iron content of less than 6% by weight, then charging the starting materials into a fluidized bed gasifier;

blowing at least one gas selected from the group consisting of hot air and combustion offgases having a temperature of above 450° C. through nozzles into the fluidized bed gasifier and thereby forming a counterflow grinding space;

introducing $CaCO_3$ into the fluidized bed gasifier; and calcining the $CaCO_3$ in the counterflow grinding space to disintegrate the $CaCO_3$ into disintegrated particles.

20. The process of claim 19, further comprising coarse crushing the starting materials prior to said subjecting of the starting materials to magnetic separation.

21. A process for working up starting materials comprising a member selected from the group consisting of RESH and shredder light fractions, the starting materials containing iron and copper, said process comprising:

charging the starting materials into a fluidized bed gasifier having a fluidized bed;

blowing at least one gas selected from the group consisting of hot air and combustion offgases having a temperature of above 450° C. through nozzles into the fluidized bed gasifier and thereby forming a counterflow grinding space;

introducing $CaCO_3$ into the fluidized bed gasifier;

calcining the $CaCO_3$ in the counterflow grinding space to disintegrate the $CaCO_3$ into disintegrated particles;

drawing the disintegrated particles off from the counterflow grinding space of the fluidized bed gasifier and screening the disintegrated particles;

melting the disintegrated particles to form a melt;

providing a metal bath reactor containing a metal bath and reducing the melt above the metal bath; and drawing off from the metal bath reactor by liquation a copper-containing phase while retaining an iron-containing phase in the metal bath reactor.

22. A process for working up starting materials comprising a member selected from the group consisting of RESH and shredder light fractions, the starting materials containing iron and copper, said process comprising:

charging the starting materials into a fluidized bed gasifier having a fluidized bed;

blowing at least one gas selected from the group consisting of hot air and combustion offgases having a temperature of above 450° C. through nozzles into the fluidized bed gasifier and thereby forming a counterflow grinding space;

introducing $CaCO_3$ into the fluidized bed gasifier;

calcining the $CaCO_3$ in the counterflow grinding space to disintegrate the $CaCO_3$ into disintegrated particles;

providing a hot cyclone and drawing off the disintegrated particles from the fluidized bed gasifier, the disintegrated particles comprising coarse stock and fine stock;

returning at least a portion of the coarse stock from the hot cyclone to the fluidized bed gasifier;

discharging the fine stock from the hot cyclone and melting the discharged fine stock to produce a molten slag;

providing a metal bath reactor containing a metal bath and reducing the molten slag above the metal bath; and drawing off from the metal bath reactor by liquation a copper-containing phase while retaining an iron-containing phase in the metal bath reactor.

* * * * *